US009416978B2

(12) United States Patent
Kwon et al.

(10) Patent No.: US 9,416,978 B2
(45) Date of Patent: Aug. 16, 2016

(54) COOKER AND BURNER ASSEMBLY THEREOF

(75) Inventors: Jung-Ju Kwon, Changwon-si (KR); Sang-Min Lyu, Changwon-si (KR); Seong-Sig Cho, Changwon-si (KR); In-Sik Min, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 954 days.

(21) Appl. No.: 13/056,575

(22) PCT Filed: May 14, 2009

(86) PCT No.: PCT/KR2009/002568
§ 371 (c)(1),
(2), (4) Date: Apr. 22, 2011

(87) PCT Pub. No.: WO2010/013888
PCT Pub. Date: Feb. 4, 2010

(65) Prior Publication Data

US 2011/0186035 A1 Aug. 4, 2011

(30) Foreign Application Priority Data

Jul. 29, 2008 (KR) ..... 10-2008-0074136

(51) Int. Cl.
*F24C 3/00* (2006.01)
*F24C 3/10* (2006.01)
*F24C 3/06* (2006.01)

(52) U.S. Cl.
CPC ..... *F24C 3/067* (2013.01)

(58) Field of Classification Search
CPC ..... F24C 3/067; F24C 3/047; F24C 3/10; F24C 3/12; F24D 14/12; F23D 2203/105
USPC .. 126/39 E, 39 H, 39 K, 39 J, 39 N, 92, 92 R, 126/192; 431/7, 101, 328, 329; 432/175; 99/389
See application file for complete search history.

(56) References Cited

U.S. PATENT DOCUMENTS 1,942,397 A * 1/1934 Cuyler ..... F24C 3/08 431/286
2,297,762 A * 10/1942 Harper ..... F23D 14/06 431/193

(Continued)

FOREIGN PATENT DOCUMENTS

KR 10-2005-0081678 A 8/2005
KR 10-0738696 B1 7/2007

(Continued)

OTHER PUBLICATIONS

PCT International Search Report dated Jan. 21, 2010 issued in Application No. PCT/KR2009/002568.

*Primary Examiner* — Avinash Savani
*Assistant Examiner* — Vivek Shirsat
(74) *Attorney, Agent, or Firm* — Ked & Associates LLP

(57) ABSTRACT

A burner assembly for a cooking appliance is provided. The burner assembly includes a first port to which a gas mixture of gas and air is supplied and a second port which is separate from the first port and to which a gas mixture of gas and air is supplied, a combustion mat at which the gas mixture supplied to the first port or the second port is burned, and a tube assembly that guides the gas and air to the first and second ports.

13 Claims, 9 Drawing Sheets

(56) References Cited

U.S. PATENT DOCUMENTS

| | | | | |
|---|---|---|---|---|
| 3,077,922 | A * | 2/1963 | Soncie | 431/283 |
| 3,606,612 | A * | 9/1971 | Reid | 431/281 |
| 3,646,927 | A * | 3/1972 | Perl | 126/39 J |
| 3,843,313 | A * | 10/1974 | Helgeson | 431/329 |
| 4,083,355 | A * | 4/1978 | Schwank | 126/39 J |
| 4,201,184 | A * | 5/1980 | Scheidler et al. | 126/39 J |
| 5,509,403 | A * | 4/1996 | Kahlke et al. | 126/39 E |
| 6,076,517 | A * | 6/2000 | Kahlke et al. | 126/39 J |
| 2002/0148460 | A1* | 10/2002 | Hsu | 126/39 E |
| 2002/0164553 | A1* | 11/2002 | Distaso et al. | 431/280 |
| 2007/0202451 | A1* | 8/2007 | Lee et al. | 431/326 |
| 2007/0207430 | A1* | 9/2007 | Lee et al. | 431/328 |
| 2007/0218776 | A1* | 9/2007 | Garrabrant et al. | 439/701 |

FOREIGN PATENT DOCUMENTS

| | | | |
|---|---|---|---|
| KR | 10-0739545 | B1 | 7/2007 |
| KR | 10-0809745 | B1 | 2/2008 |
| KR | 10-0829628 | B1 | 5/2008 |

* cited by examiner

COOKER AND BURNER ASSEMBLY THEREOF

CROSS-REFERENCE TO RELATED APPLICATIONS

This application is a U.S. National Stage Application under 35 U.S.C. §371 of PCT Application No. filed May 14, 2009, which claims priority to Korean Patent Application No. 10-2008-0074136 filed in Korea on Jul. 29, 2008, which is hereby incorporated by reference in its entirety.

BACKGROUND OF THE INVENTION

1. Field of the Invention

The present invention relates to a cooking appliance and a burner assembly thereof.

2. Description of the Related Art

Cooking appliances are appliances that heat food, using gas or electricity. In general, a plurality of burner units are provided at the upper portion of cooking appliances using gas and food is directly heated by heating a vessel filled with food by the flame generated in the process of gas combustion in the burner unit. The flame generated by the appliance is exposed to the outside.

SUMMARY OF THE INVENTION

It is an object of the present invention to provide a cooking appliance manufactured to be safely used and a burner assembly of the cooking appliance.

It is another object of the present invention to provide a cooking assembly of which efficiency in cooking is provided and a burner assembly of the cooking appliance.

It is another object of the present invention to provide a cooking appliance having a simple structure and a burner assembly of the cooking appliance.

The burner assembly of a cooking appliance according to an aspect of the present invention includes: a first port where gas mixture of gas and air is supplied and a second port that is separated from the first port and where gas mixture of gas and air is supplied; a combustion mat where the gas mixture that is supplied to the first port or the second port is burned; and a tube assembly that guides gas and air to the ports.

A cooking appliance according to another aspect of the present invention includes: a burner assembly that includes a burner port having a first space where gas mixture of gas and air is supplied and a second space that is separated from the first space and where gas mixture is supplied, and a combustion mat where at least one gas mixture in the first space and the second space is burned; a tube assembly that guides the gas mixture to the spaces; and a nozzle assembly that injects gas to the tube assembly.

A cooking appliance according to another aspect of the present invention includes: a first space where gas mixture of gas and air is supplied; a second space that is separated from the first space and where gas mixture of gas and air is supplied; a first mixing channel and a second mixing channel that mix gas with air that will be supplied to the spaces; an intake channel into which external air that will flows into the mixing channels flows; and an exhaust channel that exhausts combustion gas generated when the gas mixture is burned in the first space and combustion gas generated when the gas mixture is burned in the second space.

According to the present invention, gas mixture is selectively burned in an outer port and an inner port in accordance with a vessel filled with food, such that it is possible to improve cooking efficiency according to the kinds of food.

Further, since whether to supply gas, the amount of supplied gas, operation of an ignition plug, and turning-on/off of light emitter are achieved by one valve assembly, it is possible to reduce the number of parts.

DETAILED DESCRIPTION OF THE PREFERRED EMBODIMENTS

An embodiment is described hereafter in detail with reference to the accompanying drawings.

Figure 1:
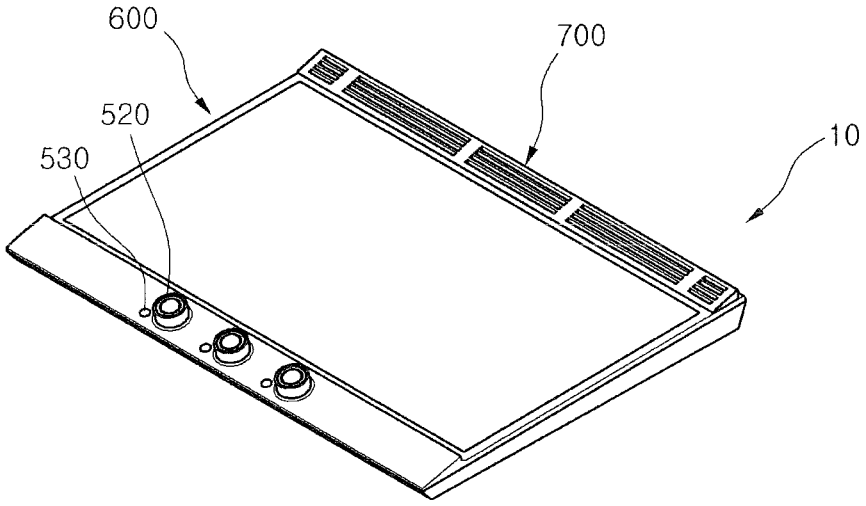
FIG. 1 is a perspective view of a cooking appliance according to an embodiment of the present invention.
Figure 2:
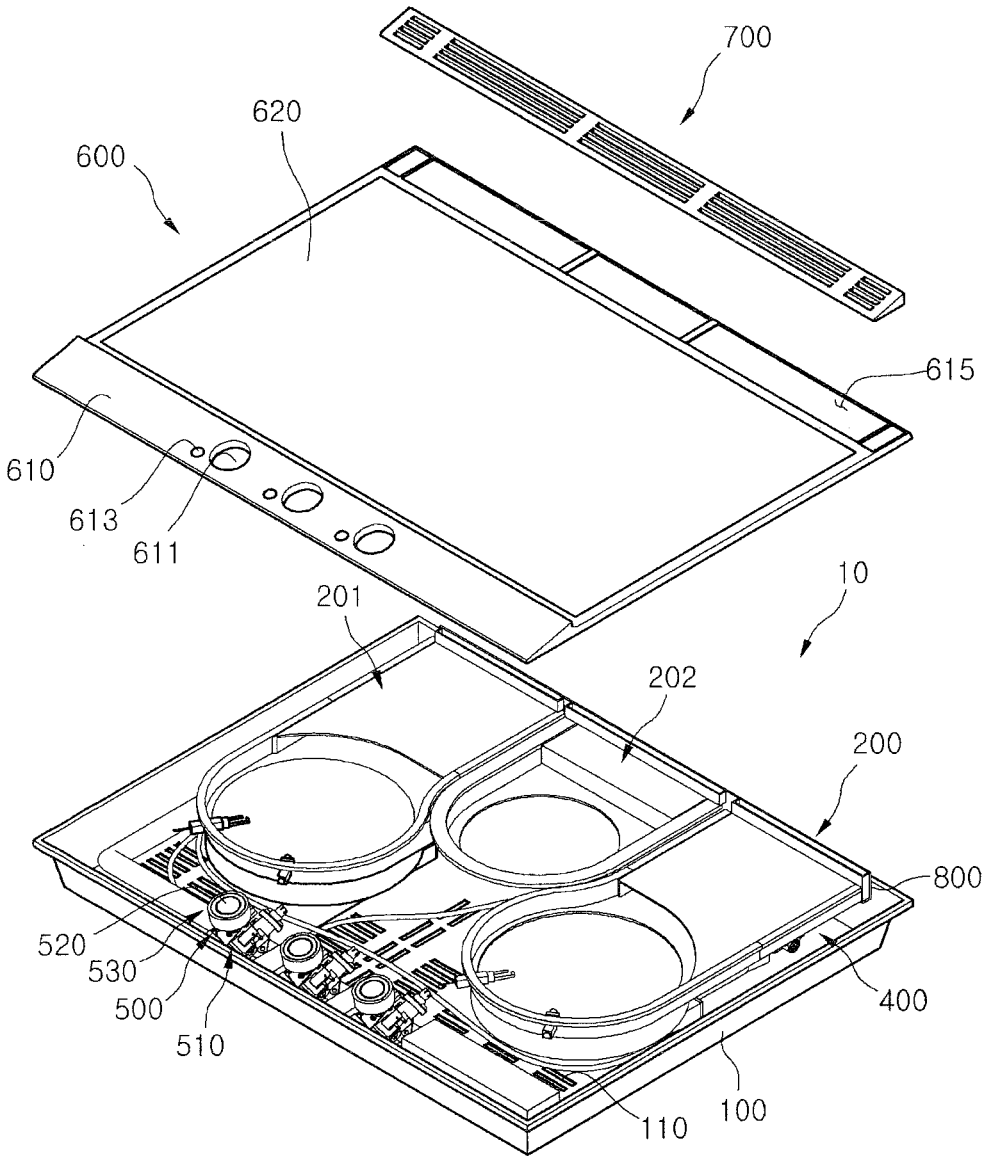
FIG. 2 is an exploded perspective view of the cooking appliance according to an embodiment of the present invention.

FIG. 1 is a perspective view of a cooking appliance according to an embodiment of the present invention and FIG. 2 is an exploded perspective view of the cooking appliance according to an embodiment of the present invention.

Referring to FIGS. 1 and 2, a cooking appliance 10 according to an embodiment of the present invention includes a cabinet 100 that defines the outer shape and a top cover 600.

The cabinet 100 is formed in a hexahedral shape with the upper surface open. The top cover 600 covers the upper opening of the cabinet 100.

A plurality of cooling holes 110 is formed in the bottom of the cabinet 100. Air for cooling the parts disposed inside the cabinet 100 can flow inside and outside the cabinet 100 through the cooling holes 110. Further, a cooling channel P3 (see FIG. 9) through which air passing through the cooling holes 110 is formed inside the cabinet 100.

Each part of the cooking appliance is described in detail hereafter.

Referring to FIG. 2, inside the cabinet 100, a plurality of burner assemblies 200, 201, and 202 that mix gas with air and burn the gas mixture, a plurality of tube assemblies 300 (see FIG. 3) that guides gas and air into the plurality of burner assemblies 200, 201, and 202, a plurality of nozzle assemblies 400 that injects gas into the tube assemblies 300 (see FIG. 3), respectively, and a plurality of control units 500 that controls the operation of the plurality of burner assemblies 200, 201, and 202.

The plurality of burner assemblies 200, 201, and 202 burn gas mixture and guide combustion gas generated in a combustion process of air for making the gas mixture and gas mixture.

The tube assembly 300 guides the gas injected from the nozzle assembly 400 and the air introduced with the gas into the tube assembly in the gas injection process to the burner assemblies 200, 201, and 202.

The control units 500 control the operation of the cooking appliance, that is, the combustion of gas mixture in the burner assemblies 200, 201, and 202.

Three burner assemblies, that is, the first burner assembly 200, the second burner assembly 201, and the third burner assembly 202 are included in the plurality of burner assemblies 200, 201, and 202, respectively.

The first and second burner assemblies 200 and 201 are disposed at the right and left inside the cabinet 100 in the figure, respectively. The third burner assembly 202 is disposed between the first and second burner assemblies 200 and 201, that is, at the center portion inside the cabinet 100. The first to third burner assemblies 200, 201, and 202 may be manufactured in different sizes.

Although it is described that three burner assemblies are provided in the cabinet 100 in this embodiment, it should be noted that the number of burner assemblies is not limited and at least one or more assemblies can be provided in the cabinet 100.

Meanwhile, the first to third burner assemblies 200, 201, and 202 are fixed in the cabinet 100, with each rear end connected to a connection bracket 800.

The connection bracket 800 has a fixing portion 810 (see FIG. 9) that is long in the left-right direction and a flow guide 820 (see FIG. 9) that vertically extends from the rear end of the fixing portion 810.

Figure 9:
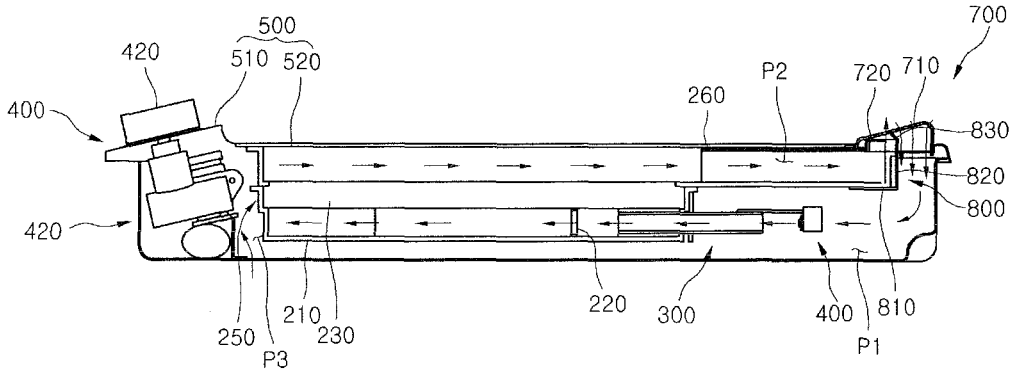
FIG. 9 is a vertical cross-sectional view illustrating air flow in the cooking appliance according to an embodiment of the present invention.

The first to third burner assemblies 200, 201, and 202 are fixed to the fixing portions 810 (see FIG. 9).

The flow guide 820 (see FIG. 9) divides a channel for air flowing through a flow guide unit 700, which is described below, and a channel for combustion gas, and guides the air and the combustion gas.

A discharge guide 830 (see FIG. 9) is provided at the end of the flow guide 820 (see FIG. 9). The discharge guide 830 (see FIG. 9) extends to be inclined upward to the front.

The discharge guide 830 (see FIG. 9) prevents air discharged outside through an exhaust portion 720 (see FIG. 9) from flowing to an intake port 710 (see FIG. 9).

On the other hand, there are provided three tube assemblies and three nozzle assemblies 400, the same as the number of burner assemblies. The nozzle assemblies 400 inject gas supplied from an external gas supplier to the tube assemblies 300, respectively.

The control units 500 are positioned in front of the burner assemblies 200, 201, and 202, respectively, that is, at the front portion inside the cabinet 100. The control units 500 include three valve assemblies 510 that adjust whether to supply gas and the amount of gas supplied to the burner assemblies 200, 201, and 202, and light emitters 530. A knob 520 is combined with the valve assembly 510. The knob 520 is a part that a user holds to operate the valve assembly 510.

The light emitters 530 show whether the burner assemblies 200, 201, and 202 are ignited to the outside while being turned on/off in accordance with the operation of the valve assemblies 510.

On the other hand, the top cover 600 has a top frame 610 and a top plate 620.

A plurality of knob-through holes 611 through which the valve assemblies 510 are disposed is formed at the front of the top frame 610. Further, a plurality of light emitter-through holes 613 through which the light emitters 530 are disposed is formed at the front of the top frame 610.

A plurality of openings 615 for sucking and exhausting air is formed at the rear of the top frame 610. The openings 615 function as passages through which external air that will be supplied to the burner assemblies 200, 201, and 202 is sucked and the combustion gas generated in the combustion process of the gas mixture is exhausted.

That is, in this embodiment, external air is sucked inside and the combustion gas inside is exhausted outside through one opening 615. In this configuration, the intake channel P1 (see FIG. 9) for external air and the exhaust channel P2 (see FIG. 9) for combustion gas are divided by the flow guide 830 in the cabinet 100, as described above.

The top plate 620 is disposed on the top frame 610. The top plate 620 transfers heat generated in the combustion process of the gas mixture in the burners 200, 201, and 202 to food (vessels filled with food).

The top plate 620, for example, may be made of glass, such as ceramic. Vessels filled with food are placed on the top plate 620. Vessel seats (not shown) for showing the seating positions of vessels may be formed on the top plate 620.

A flow guide unit 700 is disposed at the rear portion of the upper surface of the top frame 610. The flow guide unit 700 guides the external air that is sucked inside to be supplied to the burner assemblies 200, 201, and 202 and the combustion gas that is discharged from the burner assemblies 200, 201, and 202.

The structure of the burner assembly is described in detail hereafter.

Figure 3:
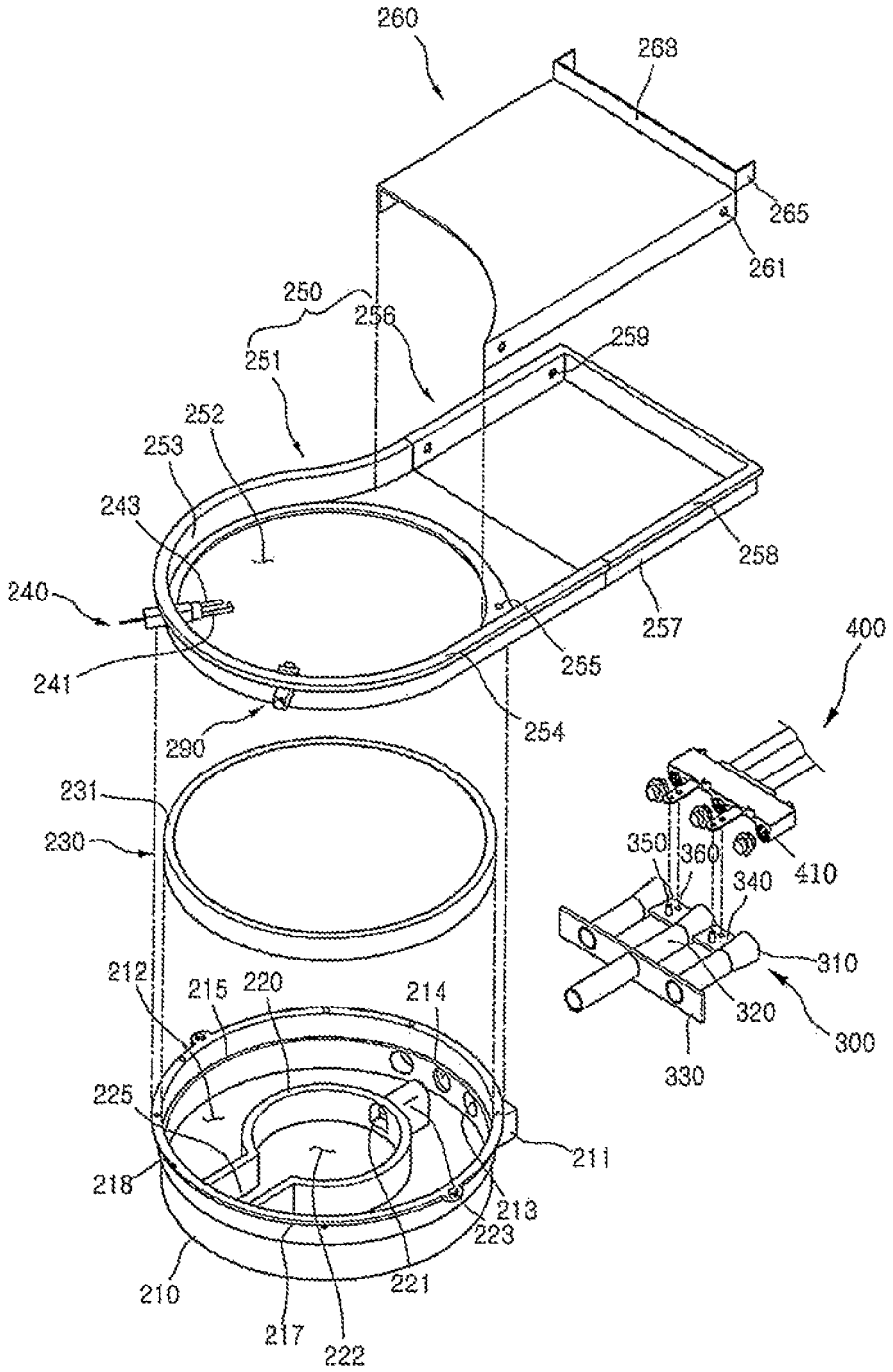
FIG. 3 is an exploded perspective view of a burner assembly according to an embodiment of the present invention.
Figure 4:
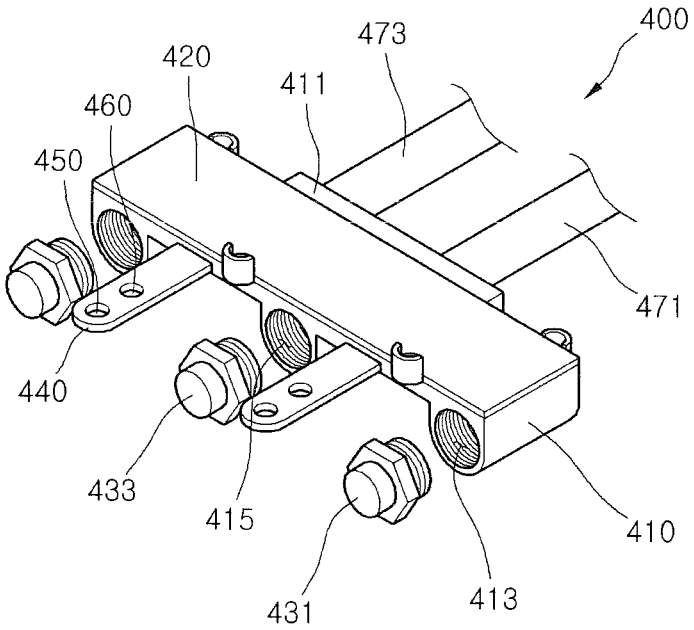
FIG. 4 is an exploded perspective view of a nozzle assembly according to an embodiment of the present invention.

FIG. 3 is an exploded perspective view of a burner assembly according to an embodiment of the present invention and FIG. 4 is an exploded perspective view of a nozzle assembly according to an embodiment of the present invention.

Since the first to third burner assemblies 200, 201, and 202 have the same configuration, except for the size, only the first burner assembly 200 (hereafter, referred to as 'burner assembly' for the convenience of description) in the first to third burner assemblies 200, 201, and 202 is described.

Referring to FIGS. 3 and 4, the burner assembly 200 according to this embodiment includes a combustion unit, an igniting unit, and an exhaust guide unit.

The combustion unit is where gas mixture is burned and includes a burner port and a combustion mat 230. The burner port includes an outer port 210 (also called "first port") and an inner port 220 (also called second port).

The igniting unit generates a spark for burning gas mixture in the combustion unit. The igniting unit includes a plug assembly 240.

The mixing unit mixes gas with air and supplies it to the combustion unit. The mixing unit includes a tube assembly 300.

The exhaust guide unit guides combustion gas that is generated in the combustion process of the gas mixture in the combustion unit to be exhausted. The exhaust guide unit includes a burner frame 250 and a barrier 260.

In detail, the outer port 210 and the inner port 220 are parts where the gas mixture is burned. The gas mixture can be independently burned in the outer port 210 and the inner port 220. That is, as a user operates the valve assembly 510, the gas mixture is burned in the outer port 210 and the inner port 220, or only in the inner port 220.

The outer port 210 can be formed, for example, in a flat cylinder shape. Further, a fixing portion 211 is formed at the rear of the outer port 210. The tube assembly 300 is fixed to the fixing portion 211.

Further, a mat seat 215 is formed on the inner circumference of the outer port 215. The bottom edge of the combustion mat 230 is seated on the mat seat 215.

Further, a support flange 217 is formed along the upper edge of the outer port 215. The support flange 217 radially extends from the upper edge of the outer port 210. The lower portion of the burner frame 250 is placed on the support flange 217. Further, a plurality of fastening holes 218 where fasteners are inserted is formed through the support flange 217 to be fastened to the burner frame.

On the other hand, at least a portion of the inner port 220 is positioned inside the outer port 210. The burner port is divided into a first space 212 defined between the outside of the inner port 220 and the inside of the outer port 210 and a second space 222 defined inside the inner port 220, by the inner port 220.

The outer port 210 has a plurality of first supply holes 213 and a second supply hole 214 formed between the plurality of first supply holes 213. The first supply holes 213 allow gas mixture to flow into the first space 212 and the second supply hole 214 allows gas mixture to flow into the second space 220.

At least a portion of the inner port 220 is formed in a cylindrical shape coaxially arranged with the outer port 210 and having a diameter relatively smaller than that of the outer port 210. In this structure, the height of the inner port 220 is a value obtained by subtracting the thickness of the combustion mat 230 from the height of the outer port 210.

The upper end of the inner port 220 is positioned at the same level as the upper end of the mat seat 215.

Further, a communication hole 221 is formed in the inner port 220. The communication hole 221 allows the gas mixture that is supplied through the second supply hole 214 to be supplied inside (the second space) the inner port 220.

The inner port 220 is provided with a connection tube 223. The connection tube 223 guides the gas mixture supplied through the second supply hole 214 to the inner port 220. One end of the connection tube 223 communicates with the communication hole 221 and the other end of the connection tube 223 is positioned close to the second supply hole 214.

An ignition guide 225 is formed at one side of the inner port 220 which is opposite to the communication hole 221. The ignition guide 225 is formed in order that the gas mixture supplied to the combustion mat 230 is ignited by the plug assembly 240. The ignition guide 225 extends toward the inner circumference of the outer port 210.

The outer port 210, inner port, 220, and connection tube 223 may be substantially integrally formed. For example, the outer port 210, inner port 220, and connection tube 223 can be integrally formed by die-casting a metal member, such as aluminum. Alternatively, it is also possible to manufacture individually the outer port 210, inner port 220, and connection tube 223, and then weld them or fasten them with fasteners.

On the other hand, the combustion mat 230 is where combustion gas is substantially burned. The combustion mat 230, for example, may be made of glass, such as ceramic. The bottom edge of the combustion mat 230 is seated on the mat seat 215 and the bottom center portion of the combustion mat 230 is seated on the inner port 220. In this structure, the upper surface of the combustion mat 230 is positioned higher than the upper surface of the support flange 217.

Further, the edge of the combustion mat 230 has a step 231. The step 231 is formed by depressing a portion of the edge of the combustion mat 230.

In this structure, the upper surface of the step 231 is positioned at the same level as the upper surface of the support flange 217.

On the other hand, the plug assemble 240 includes an ignition plug 241 and a plug target 243. The ignition plug 241 and the plug target 243 generate a spark for igniting gas mixture.

The plug target 243 is made of metal and spaced apart from the ignition plug 241. When power is supplied to the ignition plug 241, a spark is generated between the ignition plug 241 and the plug target 243.

The plug assembly 240 is disposed through the burner frame 250.

Further, ends of the ignition plug 241 and the plug target 243 which generate a spark are positioned over the ignition guide 225. In more detail, the ends of the ignition plug 241 and the plug target 243 are positioned over the interface (right over the inner port) of the first space 212 and the second space 222.

On the other hand, the burner frame 250 is disposed above the burner port and the combustion mat 230. The burner frame 250 includes a first burner frame 251 and a second burner frame 256. The first burner frame 251 guides the combustion gas generated when gas mixture is burned in the combustion mat 230 to the second burner frame 256. The second burner frame 256 guides the combustion gas to the flow guide unit 700.

The first and second burner frames 251 and 256 may be integrally formed, or individually formed and then welded or fastened by fasteners.

The first burner frame 251 fixes the position of the combustion mate by being fixed to the outer port 210.

A heat transfer hole 252 that allows the heat generated when gas mixture is burned in the combustion mat 230 to be easily transferred to the top plate 620 is formed at the center portion of the first burner frame 251. The heat transfer hole 252 can by formed in a shape corresponding to the upper surface of the combustion mat 230.

The upper surface of the combustion mat 230 is inserted into the heat transfer hole 252, when the first burner frame 251 is fixed to the outer port 210.

The first burner frame 251 has a guide rib 253 and a plate support rib 254. The guide rib 253 allows the combustion gas generated when gas mixture is burned in the combustion mat 230 to flow to the second burner frame 256, without being dispersed.

The guide rib 253 guides the heat generated when combustion gas is burned in the combustion mat 230 to be concentrated to the top plate 620, without being dispersed.

The guide rib 253 extends upward from the bottom edge of the first burner frame 251, except for the rear end of the first burner frame 251.

The plate support rib 254 supports the bottom of the top plate 620. The plate support rib 254 extends outside the first burner frame 251 from the guide rib 253.

Further, a plurality of through-holes 255 is formed at the bottom of the first burner frame 251 adjacent to the heat transfer hole 252. Fasteners that are inserted in the outer port 210 pass through the through-holes 255.

The second burner frame 256 has guide ribs 257 and plate support ribs 258. The guide rib 257 extends upward from both side of the second burner frame 256, at the same height as the guide rib 253 of the first burner frame 251.

The plate support rib 258 extends to both sides from the upper ends of the guide ribs 257. Further, the plate support rib 258 supports the top plate 620.

Through-holes 259 through which fasteners that are inserted in the barrier 260 are formed at the guide ribs 257.

On the other hand, the intake channel P1 (see FIG. 9) is formed under the burner frame 250 inside the cabinet 210. Air that is supplied to the burner assemblies 200, 201, and 202 flows through the intake channel P1.

In this embodiment, the intake channel P1 is substantially defined by the bottom of the cabinet 100 and the bottom of the second burner frame 265.

The barrier 260 is fastened to the upper portion of the second burner frame 256 and substantially positioned between the top plate 620 and the second burner frame 256. The barrier 260 is formed in a U-shape.

In this structure, the rear end of the barrier 260 is spaced apart from the rear end of the second burner frame 256. Therefore, the exhaust channel P2 through which the combustion gas flow is defined by the second burner frame 256 and the barrier 260. The combustion gas flowing through the exhaust channel P2 is discharged through a gap between the second burner frame 256 and the barrier 260. However, the exhaust channel P2 may be defined by the second burner frame 256 and the top plate 620, with the barrier 260 removed.

A plurality of fastening holes 261 through which fasteners that are inserted in the second burner frame 256 is formed at both sides of the barrier 260.

A guide rib 263 that guides the combustion gas flowing through the exhaust channel p2 to the flow guide unit 700 is formed at the rear end of the barrier 260. The guide rib 263 extends upward from the rear end of the upper surface of the barrier 260

The barrier 260 is provided with dividing ribs 265. The dividing ribs 265 of the barrier 260 are provided to prevent the combustion gases that are guided to the flow guide unit 700 through the exhaust channel P2 of each other burner assemblies 200, 201, and 202 from being mixed with each other. The dividing ribs 265 extend rearward from the ends of both sides of the guide rib 263.

The barrier 260 allows some of the heat of the combustion gas flowing through the exhaust channel P2, in more detail, only the heat to warm up food to be transferred to the top plate 620.

Accordingly, warm zones where food can be warmed by the heat of the combustion gas flowing through the exhaust channels P2 are formed over the exhaust channels P2 in the top plate 620.

On the other hand, a thermo couple 290 is combined with the first burner frame 251. A portion of the thermo couple 290 is positioned inside the first burner frame 251 through the first burner frame 251 and the other portion is disposed outside the first burner frame 251.

The thermo couple 290 generates an electromotive force, using a difference in temperature between the portion inside the first burner frame 251 and the portion outside the first burner frame 251 while combustion gas is burned in the combustion mat 230.

The valve assembly 510 that supplies gas is kept open or the open valve assembly 510 is closed, in accordance with whether the thermo couple 290 generates the electromotive force.

On the other hand, the tube assembly 300 includes a plurality of first mixing tubes 310, a second mixing tube 320 disposed between the plurality of first mixing tubes 310, a close contact portion 330 connected with the mixing tubes, and connectors 340 for connection with the nozzle assembly.

The first and second mixing tubes 310 and 320 provide first and second mixing channels where gas and air are substantially mixed. Further, the plurality of first mixing tubes 310 and the second mixing tube 320 are arranged in parallel.

The first mixing tubes 310 communicate with the first supply holes 213, respectively. The second mixing tube 320 is inserted in the connection tube 223 through the second supply hole 214. Accordingly, the length of the second mixing tube 220 is larger than that of the first mixing tube 210.

The close contact portion 330 is fixed to the fixing portion 211. Though not shown, a gasket for preventing leakage of gas mixture may be provided between the fixing portion 211 and the close contact portion 330.

The connectors 340 substantially connect the first mixing tubes 310 with the second mixing tube 320.

A fastening protrusion 350 and a fastening hole 360 for fastening the nozzle assembly 400 are formed in the connector 340.

Referring to FIG. 4, the nozzle assembly 400 includes a nozzle body 410, a nozzle cover 420, and a plurality of injection nozzles 431 and 433.

A hose connecting portion 411 is formed at the rear of the nozzle body 410. Two supply holes (not shown are formed in the hose connecting portion 411. Gas hoses 471 and 473 are connected to the supply holes, respectively. The gas hoses 471 and 473 are composed of a first gas hose 471 through which gas that will be supplied to the first space 212 flaws and a second gas hose 472 through which gas that will be supplied to the second space 222 flows.

A plurality of injection holes 413 and 415 where the injection nozzles 431 and 433 are connected, respectively, are formed through the front of the nozzle body 410.

The plurality of injection nozzles 431 and 433 are composed of a first injection nozzle 431 that injects gas to the first mixing tube 310 and a second injection nozzle 433 that injects gas to the second mixing tube 320. The plurality of injection holes 413 and 415 are composed of a first injection hole 413 where the first injection nozzle 431 is connected and a second injection hole 415 where the second injection nozzle 433 is connected.

A thread is formed on the inner circumference of the plurality of injection holes 413 and 415 to combine the injection nozzle 413 and 415, respectively.

Two gas channels divided by a dividing member (not shown) is formed in the nozzle body 410. Any one of the gas channel communicates with the first gas hose 471 and the other communicates with the second gas hose 472.

The nozzle body 410 is manufactured by die-casting aluminum and the injection hole 412 is formed by tapping to minimize the amount of material and effort for manufacturing the nozzle body 410.

The top cover 420 covers the upper opening of the nozzle body 410. Therefore, two channels are formed between the nozzle body 410 and the nozzle cover 420.

The injection nozzles 431 and 433 inject gas at high pressure to the mixing tubes 310 and 320, respectively. The injection nozzles 413 and 415 are connected to the injection holes 413 and 415, respectively. The injection nozzles 431 and 433 connected to the injection holes 413 and 415 are spaced apart from the rear end of the mixing tubes 310 and 430 in order that air around the mixing tubes 310 and 330 flows into the mixing tubes 310 and 330 while the gas injected from the injection nozzles 431 and 433 flows into the mixing tube 310 and 330.

A thread corresponding to the thread of the injection holes 413 and 415 are formed on the outer circumference of the injection nozzles 431 and 433.

A plurality of fastening ribs 440 is formed at the nozzle body 410. The fastening ribs 440 extend forward from the front of the nozzle body 410, that is, toward the tube assembly 300. A through-hole 460 through which a fastener passes and a guide groove 450 in which the guide protrusion 350 of the tube assembly 300 is inserted are formed at the fastening rib 440.

Therefore, the tube assembly 300 and the nozzle assembly 400 are combined by the fastening members passing through the through-holes 460 are inserted in the fastening holes 360 of the tube assembly 300, with the guide protrusions 350 inserted in the guide hole 450.

Though not shown, a nozzle gasket may be provided between the nozzle body 410 and the nozzle cover 420. The nozzle gasket blocks the gap between the nozzle body 410 and the nozzle cover 420. The nozzle gasket prevents gas from leaking through the gap between the nozzle body 410 and the nozzle cover 420.

Figure 5:
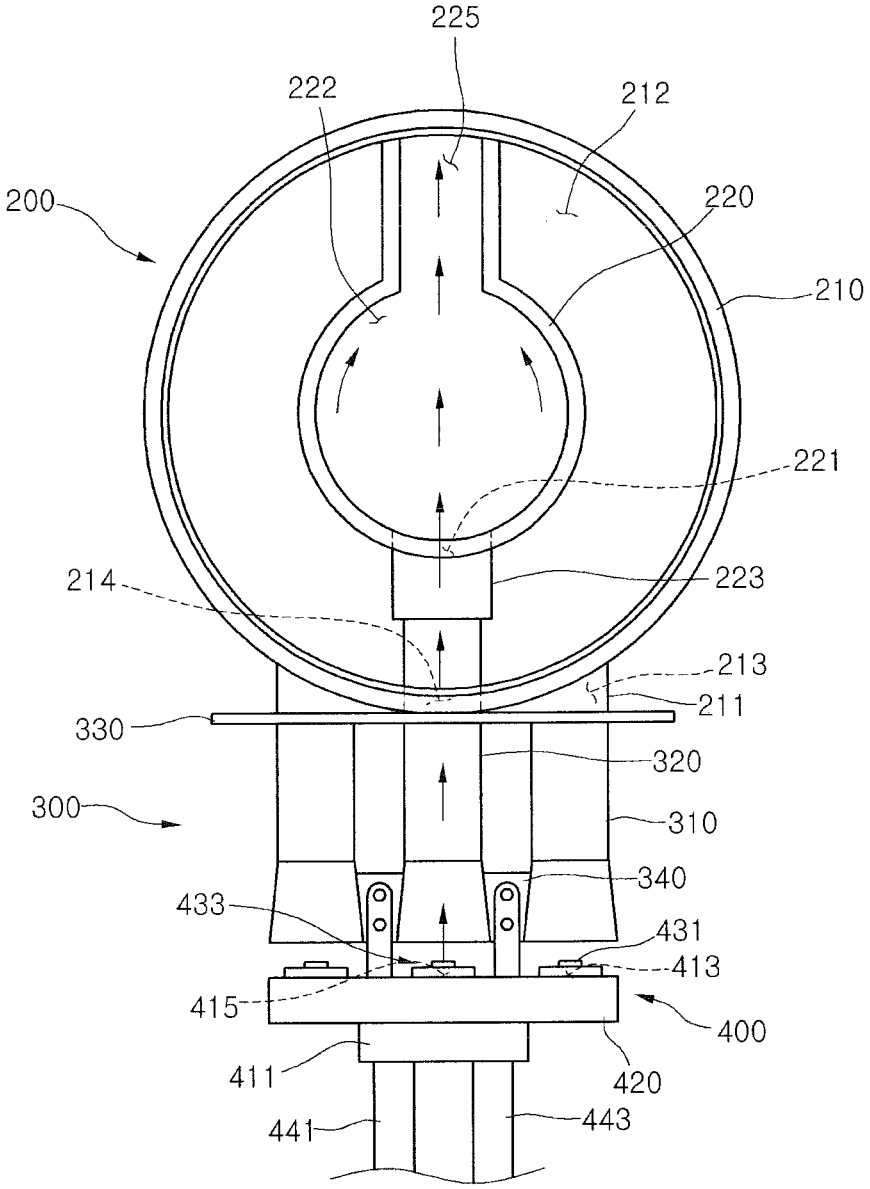
FIG. 5 is a view illustrating gas flow when gas mixture is burned only in an inner port according to an embodiment of the present invention.
Figure 6:
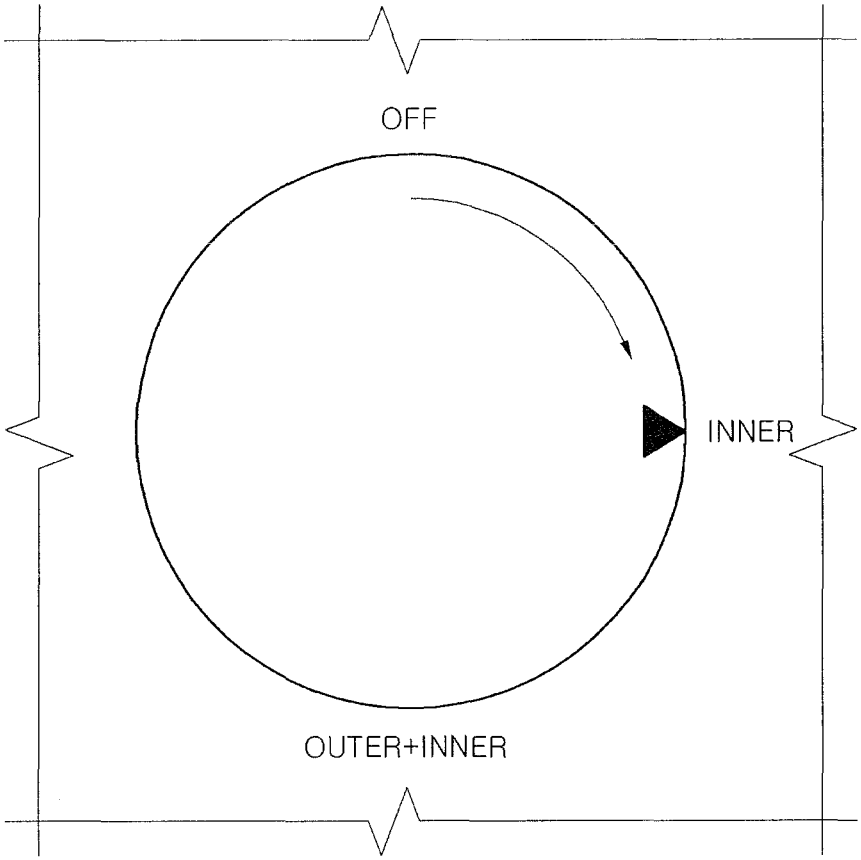
FIG. 6 is a view showing a knob that has been operated to burn gas mixture only in the inner port.
Figure 7:
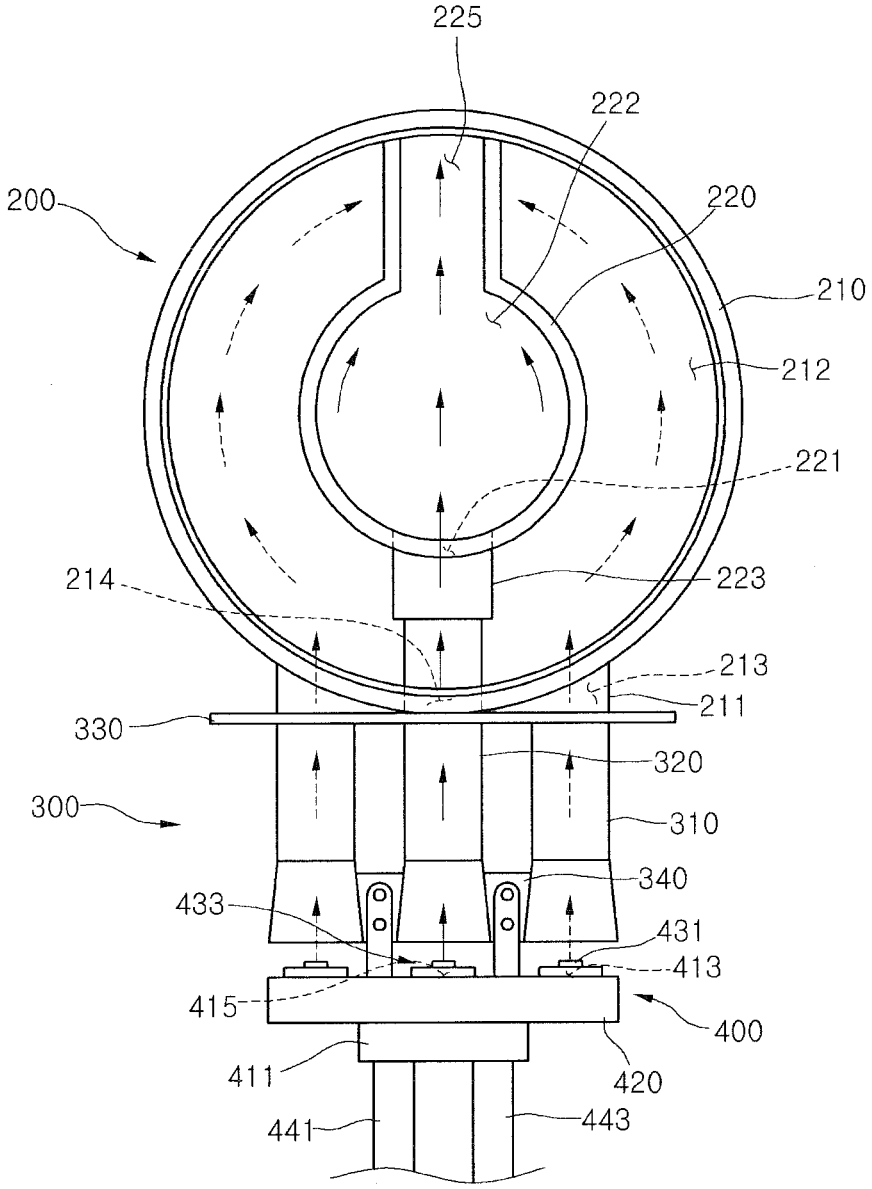
FIG. 7 is a view illustrating air flow when gas mixture is burned in an outer port and an inner port according to an embodiment of the present invention.
Figure 8:
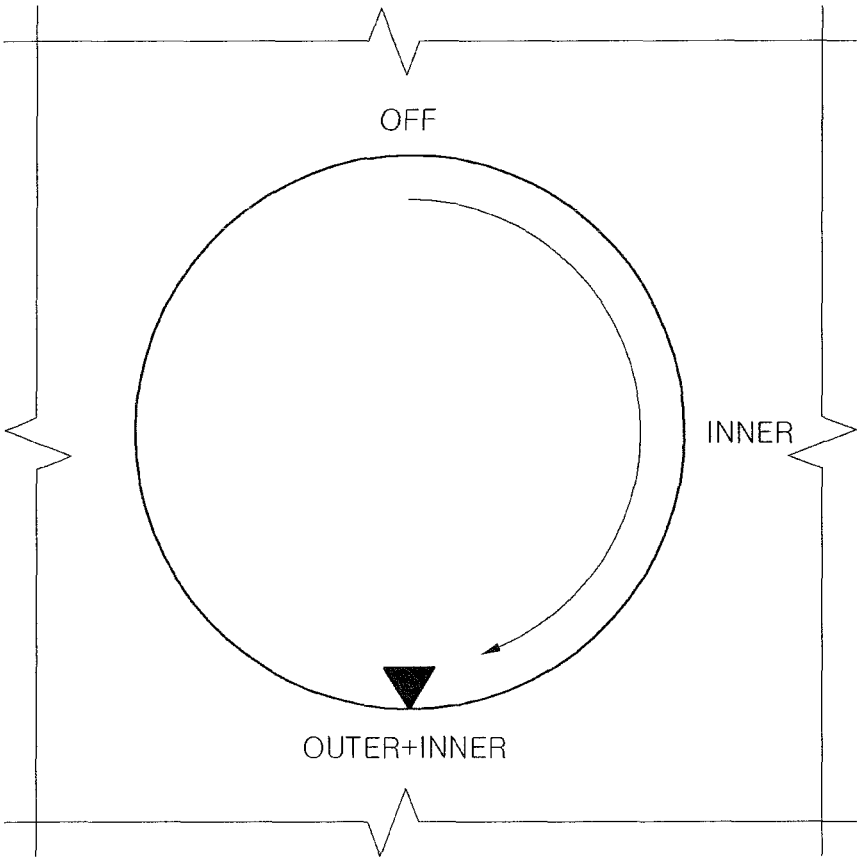
FIG. 8 is a view showing a knob that has been operated to burn gas mixture only in the outer port and the inner port.

FIG. 5 is a view illustrating gas flow when gas mixture is burned only in an inner port according to an embodiment of the present invention, FIG. 6 is a view showing a knob that has been operated to burn gas mixture only in the inner port, FIG. 7 is a view illustrating air flow when gas mixture is burned in an outer port and an inner port according to an embodiment of the present invention, FIG. 8 is a view showing a knob that has been operated to burn gas mixture only in the outer port and the inner port, and FIG. 9 is a vertical cross-sectional view illustrating air flow in the cooking appliance according to an embodiment of the present invention.

Referring first to FIGS. 5 and 6, in order to burn gas mixture only in the inner port 220, that is, when the size of a vessel filled with food corresponds to the size of the inner port 220, the valve assembly 510 is operated by the knob 520 such that gas mixture is supplied only to the inner port 220.

Accordingly, gas flows only to the second gas hose 473. Further, the gas is injected from the second injection nozzle 433.

The gas injected from the second injection nozzle 433 is supplied together with air to the inner port 220 through the second mixing tube 320.

Meanwhile, the valve assembly 510 operates the plug assembly when the gas is supplied to the inner port 220. Accordingly, the gas mixture supplied to the inner port is ignited. Further, substantial combustion of the gas mixture occurs at a portion of the combustion mat 230 which corresponds to the inner port 220.

Further, the valve assembly 510 turns on the indication lamp 530, when the gas is supplied to the inner port 220. Accordingly, a user can easily recognize that the gas mixture is being burned in the burner assembly 200.

Next, referring to FIGS. 7 and 8, when the size of a vessel filled with food corresponds to the size of the outer port 210 including the inner port 220, the valve assembly 510 is operated by the knob 520 such that gas mixture is supplied to the outer port 210 and the inner port 220.

Accordingly, gas flows into the first gas hose 471 and the second gas hose 473, such that the gas is injected from the first injection nozzle 431 and the second injection nozzle 433

Further, the gas injected from the first injection nozzle 431 and the second injection nozzle 433 is supplied to the outer port 210 and the inner port 220 through the first mixing tube 310 and the second mixing tube 320, respectively.

Further, since the plug assembly 240 is operated by the valve assembly 510, the gas mixture supplied to the outer port 210 and the inner port 220 is ignited and burned. Further, substantial combustion of the gas mixture occurs throughout the combustion mat 230 which corresponds to the outer port 210 and the inner port 220. Further, the indication lamp 530 is turned on by the valve assembly 510.

Meanwhile, referring to FIG. 9, the heat generated while the gas mixture is burned in the combustion mate 230 is transferred to the vessel placed on the top plate through the top plate 620. Therefore, the vessel is substantially heated and the food in the vessel is cooked.

The high-temperature combustion gas generated while the gas mixture is burned in the combustion mat 230 flows to the exhaust channel P2. Further, the combustion gas is exhausted to the outside through the exhaust portion 720 of the flow guide unit 700 communicating with the exhaust channel P2. The guide 820 of the connection bracket 800 guides forward the combustion gas discharged through the exhaust portion 720. Therefore, the combustion gas discharged through the exhaust portion 720 is prevented from staining the rear wall, that is, the wall of a kitchen.

In this process, since the combustion gas is at higher temperature and pressure than the air outside the cooking appliance, it is discharged to the outside of the cooking appliance at low pressure (substantially atmospheric pressure, through the exhaust portion 720 by convection.

In contrast, the gas injected from the injection nozzle 431 and 433 flows at high speed into the tube assembly 300. Since the gas passes through the mixing tubes 301 and 320 of the tube assembly 300 at high speed, the pressure around the inlet of the mixing tubes 310 and 320 is lower than the atmospheric pressure (the pressure outside the cooking appliance), by Bernoulli's theorem. Therefore, the air outside the cooking appliance 10 flows into the intake channel P1 through the sucking port 710.

The intake channel P1 extends in parallel with the exhaust channel P2. Further, a portion of the exhaust channel P2 is positioned over the intake channel P1.

Further, as shown in FIG. 9, since combustion gas flows inside and outside through the flow guide unit 700, the flow direction of the air in the intake channel is opposite to the flow direction of the combustion gas in the exhaust channel.

The barrier 620 transfers some of the heat of the combustion gas flowing through the exhaust channel P2 to the top plate 620. Therefore, food can be warmed in the warm zone of the top plate 620 over the exhaust channel P2.

The air outside the cooking appliance is sucked inside the cabinet 100 through the cooling hole 110 of the cabinet 100 and flows through a cooling channel Pc.

As described above, the air flowing through the cooling channel cools the parts constituting the control unit 400 and then is discharged through the cooling hole 110.

In this process, the air in the intake channel flows toward the nozzle assembly and some of the air in the cooling channel flows away from the nozzle assembly.

Further, in the embodiment described above, a cooling fan for cooling the electrical parts in the cabinet, including the control unit, is not provided. However, a cooling fan may be provided to efficiently cooling the electrical parts.

Although a single combustion mat 230 is disposed over the outer port 210 and the inner port 220 in the above embodiment, a combustion mat may be composed of an outer mat and an inner pat, the outer mat is disposed over the outer port and the inner mat is disposed over the inner port. The outer mat and the inner mat may be separate or connected by a frame.

What is claimed is:

1. A burner assembly of a cooking appliance, comprising:

a first port having a first chamber to which a gas mixture of gas and air is supplied and a second port, which is separate from the first port and having a second chamber to which a gas mixture of gas and air is supplied, wherein a first wall and it bottom wall define the first chamber, and wherein a second wall and the bottom wall define the second chamber;

a combustion mat at which the gas mixture supplied to the first port or the second port is burned;

a tube assembly that guides gas and air to the first and second ports;

a plug assembly that ignites the gas mixture the first port and the gas mixture in the second port;

a burner frame disposed above the combustion mat, that defines an exhaust channel through which combustion gas is exhausted; and an ignition guide that connects the first wall and the second wall, and that extends upward from the bottom wall, wherein an inner surface of the first wall and the ignition guide define a guide chamber through which the gas mixture in the second chamber is guided to flow toward the plug assembly, wherein the combustion mat is disposed at an upper side of the ignition guide and is seated on the ignition guide, wherein the plug assembly is disposed above the combustion mat and mounted to the burner frame, and wherein the tube assembly includes:

at least one first mixing tube that guides the gas and air to the first port; and a second mixing tube that guides the gas and air to the second port and is connected to the second port.

2. The burner assembly of a cooking appliance according to claim 1, wherein at least a portion of the second port is positioned inside the first part.

3. The burner assembly of a cooking appliance according to claim 1, wherein the first port is integrally thrilled with the second port.

4. The burner assembly of a cooking appliance according to claim 1, wherein the at least one first mixing tube and the second mixing tube are arranged in parallel.

5. The burner assembly of a cooking appliance according to claim 2, wherein the second mixing tube communicates with the second port, through the first port.

6. The burner assembly of a cooking appliance according to claim 1, wherein the combustion mat is a single part, wherein the gas mixture in the first port is burned at a partial region of the combustion mat, and wherein the gas mixture in the second port is burned at another partial region.

7. A cooking appliance, comprising:

a first wall that defines a first space to which a gas mixture of gas and air is supplied;

a second wall that defines a second space, which is separate from the first space and to which a gas mixture of gas and air is supplied, the second wall being disposed in the first space;

a bottom wall that defines the first and second spaces;

a first mixing channel and a second mixing channel that mix gas with air, which is supplied to the first and second spaces, respectively;

an intake channel through which external air flows into the mixing channels;

a combustion mat at which the gas mixture supplied to the first port or the second port is burned;

a burner frame that defines an exhaust channel through which a combustion gas generated when the gas mixture is burned in the first space and a combustion as generated when the gas mixture is burned in the second space are exhausted, wherein the burner frame is disposed above the combustion mat;

a plug assembly that ignites the gas mixture in the first space and the gas mixture in the second space, and is mounted to the burner frame, wherein the plug assembly is disposed above the combustion mat;

an ignition guide that extends from the bottom wall toward the combustion mat, wherein the ignition guide connects the second wall to the first wall, wherein an inner surface of the first wall, the bottom wall, and the ignition guide define a guide chamber that guides the gas mixture in the second space flow toward the plug assembly, and wherein the ignition guide support the combustion mat.

8. The cooking appliance according to claim 7, wherein at least a portion of the second mixing channel is positioned inside the first space.

9. The cooking appliance according to claim 1, further including first and second portions that define the ignition guide, wherein the first and second portions support the combustion mat.

10. The cooking appliance according to claim 9, wherein the first portion is in parallel to the second portion.

11. The cooking appliance according to claim 9, wherein a diameter of the second chamber is greater than a distance between the first and second portions.

12. The cooking appliance according to claim 7, further including first and second portions that define the ignition guide, wherein the first and second portions support the combustion mat.

13. The cooking appliance according to claim 12, wherein at least one of the first portion or the second portion extends parallel to at least one of the first mixing channel or the second mixing channel.

* * * * *